US007759880B2

(12) United States Patent
Maros et al.

(10) Patent No.: US 7,759,880 B2
(45) Date of Patent: Jul. 20, 2010

(54) COMBINED BALLAST FOR FLUORESCENT LAMP AND LIGHT EMITTING DIODE AND METHOD OF DRIVING SAME

(75) Inventors: Istvan Maros, Budapest (HU); Istvan Peter Bakk, Torokbalint (HU); Louis R. Nerone, Brecksville, OH (US); Timothy Chen, Aurora, OH (US); Nitin Kumar, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 297 days.

(21) Appl. No.: 12/029,811

(22) Filed: Feb. 12, 2008

(65) Prior Publication Data

US 2009/0200955 A1 Aug. 13, 2009

(51) Int. Cl.
*H05B 37/00* (2006.01)

(52) U.S. Cl. ..... 315/307; 315/209 R; 315/219; 315/224

(58) Field of Classification Search ..... 315/224, 315/219, 209 R, 291, 307, 312
See application file for complete search history.

(56) References Cited

U.S. PATENT DOCUMENTS

| | | | | |
|---|---|---|---|---|
| 6,400,104 | B1 | 6/2002 | Ham | |
| 7,688,005 | B2 * | 3/2010 | Reid | 315/307 |
| 2002/0118538 | A1 | 8/2002 | Calon et al. | |
| 2006/0061300 | A1 | 3/2006 | Biebl et al. | |
| 2006/0290299 | A1 | 12/2006 | Busse et al. | |
| 2007/0133206 | A1 | 6/2007 | Demarest et al. | |
| 2007/0146565 | A1 | 6/2007 | Jeon et al. | |
| 2007/0210719 | A1 | 9/2007 | Busse et al. | |

FOREIGN PATENT DOCUMENTS

| | | |
|---|---|---|
| JP | 10275600 A | 10/1998 |
| JP | 2003-309971 | 10/2003 |
| JP | 2007-250341 | 9/2007 |
| JP | 2007-311317 | 11/2007 |
| WO | WO 2007/066252 A1 | 6/2007 |

OTHER PUBLICATIONS

PCT/US2009/030214 International Search Report, mailed Apr. 16, 2009.

* cited by examiner

*Primary Examiner*—David Hung Vu
(74) *Attorney, Agent, or Firm*—Fay Sharpe LLP

(57) ABSTRACT

A circuit or combined ballast for driving a fluorescent lamp and at least one light emitting diode (LED) includes an integrated driver circuit having an alternating current (AC) circuit that includes at least one ballast coil for driving the fluorescent lamp and a direct current circuit for driving the LED having a secondary winding inductively coupled with the fluorescent lamp ballast coil for driving the LED. A method of driving a lamp assembly includes at least one fluorescent lamp and at least one light emitting diode (LED) and a combined driver circuit for supplying both the fluorescent lamp and the LED. The combined driver circuit supplies high voltage AC supply to a first portion of the driver circuit to the fluorescent lamp, supplies low voltage DC supply in a second portion of the driver circuit to the LED, and provides a secondary winding in the second portion of the driver circuit that is inductively coupled with a ballast coil in the first portion of the driver circuit that drives the fluorescent lamp.

19 Claims, 7 Drawing Sheets

COMBINED BALLAST FOR FLUORESCENT LAMP AND LIGHT EMITTING DIODE AND METHOD OF DRIVING SAME

BACKGROUND

This application relates to a lamp assembly, and more particularly a combined lamp assembly incorporating a fluorescent lamp and more preferably a compact fluorescent lamp (CFL) light source and at least one light emitting diode (LED) light source. More particularly, this application relates to a combined arrangement for operating the lamp assembly, and particularly a combined driver circuit for the two light sources. However, it will be appreciated that the disclosure may find use in related environments and applications.

It is generally known to provide a lamp assembly having combined light sources. For example, different types of light sources may be combined in a lamp assembly where each light source provides a different type of light output, and the combined output provides a mixture of light that cannot be achieved by either light source on its own. Commonly owned and co-pending application (U.S. Ser. No. 12/021,880, filed 29 Jan. 2008) discloses a combined lamp assembly that includes a CFL light source and at least one LED light source and the disclosure thereof is expressly incorporated herein by reference. Particularly, the LED is preferably one that emits red light. The red light of the LED is mixed with the output of the CFL to advantageously provide an enriched, red color to the combined light output.

Known lamp assemblies that combine light sources usually employ separate, first and second driver circuits, namely a dedicated first driver circuit for controlling the CFL and a dedicated second driver circuit for controlling the LED. The CFL requires a high voltage, AC source and the first driver circuit or ballast associated therewith is an area of continued development and improvement. The LED, on the other hand, usually requires a DC power source and a low voltage. Thus, although combining the different types of light sources in a single lamp assembly is advantageous for light output, the combination presents unique issues since the needed driver circuits are so different. As will be appreciated, separate driver circuits add undesired cost and complexity to the lamp assembly.

Still another consideration is the space requirement of the lamp assembly. It is difficult to include separate LED and CFL driving circuits in the limited volume associated with the lamp assembly. Likewise, if the driving circuits are combined, then the same concerns with space requirements still exist.

There are several ways of driving a LED from a line-AC source. For example, one proposal uses a transformer for low voltage driving, and a resistor or capacitor for current limiting, that is before or after the transformer. Another option is to employ a current generator circuit using a switching power supply with a current limiter or generator. The switching power supply is connected with several LEDs. The current is limited by a capacitor and/or resistor.

One proposed solution to an integrated or combined circuit is disclosed in published international application WO2007/066252 A1. An LED circuit is connected in series with the fluorescent lamp and the high frequency alternating current that drives the fluorescent light source is supplied to the LED circuits. Each LED circuit has at least three parallel branches, namely, a first branch includes an impedance circuit while the second and third branches contain the LEDs which are connected in anti-parallel relation. The impedance circuit controls the amount of current flowing through one of the second and third branches at any one time (i.e., if there is high impedance, then a large part of the AC flows through the second or third branches, and vice versa if there is low impedance, then a small portion of the AC current flows through the second and third branches). Since the LED allows current to flow in only one direction, and the LEDs are arranged in anti-parallel relation in the second and third branches, the alternating current can flow through one of the second and third branches at any one time.

This solution is not as desirable since the LED and the fluorescent lamp are connected in series. Since, as noted above, an individual LED is usually driven by DC current, and fluorescent lamps are driven by AC current, the combined lamp assembly necessarily requires at least two LEDs—one operable in each current direction, Moreover, since the components are arranged in series relation, the current that flows through the fluorescent lamp and the LED driver circuit is necessarily the same. Further, ignition of the fluorescent lamp requires high voltage (on the order of 100 volts, for example, for a compact fluorescent lamp assembly). This voltage level is not desired for LEDs since it could potentially damage the LED light source.

Thus, a need exists for an inexpensive, compact, low power, efficient combined light assembly and associated combined driver circuit that addresses the competing, disparate requirements of the different types of light sources and overcomes the deficiencies identified above.

BRIEF DESCRIPTION

The present application discloses a combined lamp assembly that incorporates different, first and second light sources (e.g., a fluorescent lamp and an LED) with a combined driver circuit wherein the LED is not driven by line AC.

The light assembly driver circuit for driving a fluorescent lamp and at least one light emitting diode (LED) preferably includes an integrated driver circuit including an alternating current (AC) circuit that includes at least one ballast coil for driving the fluorescent lamp, and a direct current circuit having a secondary winding inductively coupled with the ballast coil for driving the LED.

In another embodiment, a charge pump circuit is added to a conventional fluorescent lamp circuit. A soft-switching capacitor is included in the charge pump capacitor. The current that is supplied to the LED is determined by the value of the capacitor, the switching frequency, and the DC bus voltage, and thus provides for a delay in current supply to the LED. This delay advantageously protects the LED from the large voltage required to ignite the fluorescent lamp.

A method of driving a lamp assembly that includes at least one fluorescent lamp and at least one light emitting diode (LED) sued a combined driver circuit for supplying both the fluorescent lamp and the LED, includes supplying high voltage AC to a first portion of the driver circuit for the fluorescent lamp; supplying low voltage DC to a second portion of the driver circuit for to the LED; and providing a secondary winding in the second portion of the driver circuit that is inductively coupled with a ballast coil in the first portion of the driver circuit that drives the fluorescent lamp.

A primary benefit is the ability to efficiently integrate the driver circuits for the combined lamp assembly.

Another benefit relates to a low cost solution to the disparate needs of the different light sources.

Yet another benefit is associated with protecting the LED from the high voltage operatively associated with the fluorescent lamp driver circuit.

Still another benefit resides in the compact, low-power dissipating LED driver combined with the fluorescent lamp driver.

A further benefit results from ease of igniting the lamp since the circuit is not loaded during ignition.

A still further benefit is provided by overvoltage protection for the LED.

Further benefits and advantages will become apparent to those skilled in the art from reading and understanding the following detailed description.

DETAILED DESCRIPTION

Figure 1:
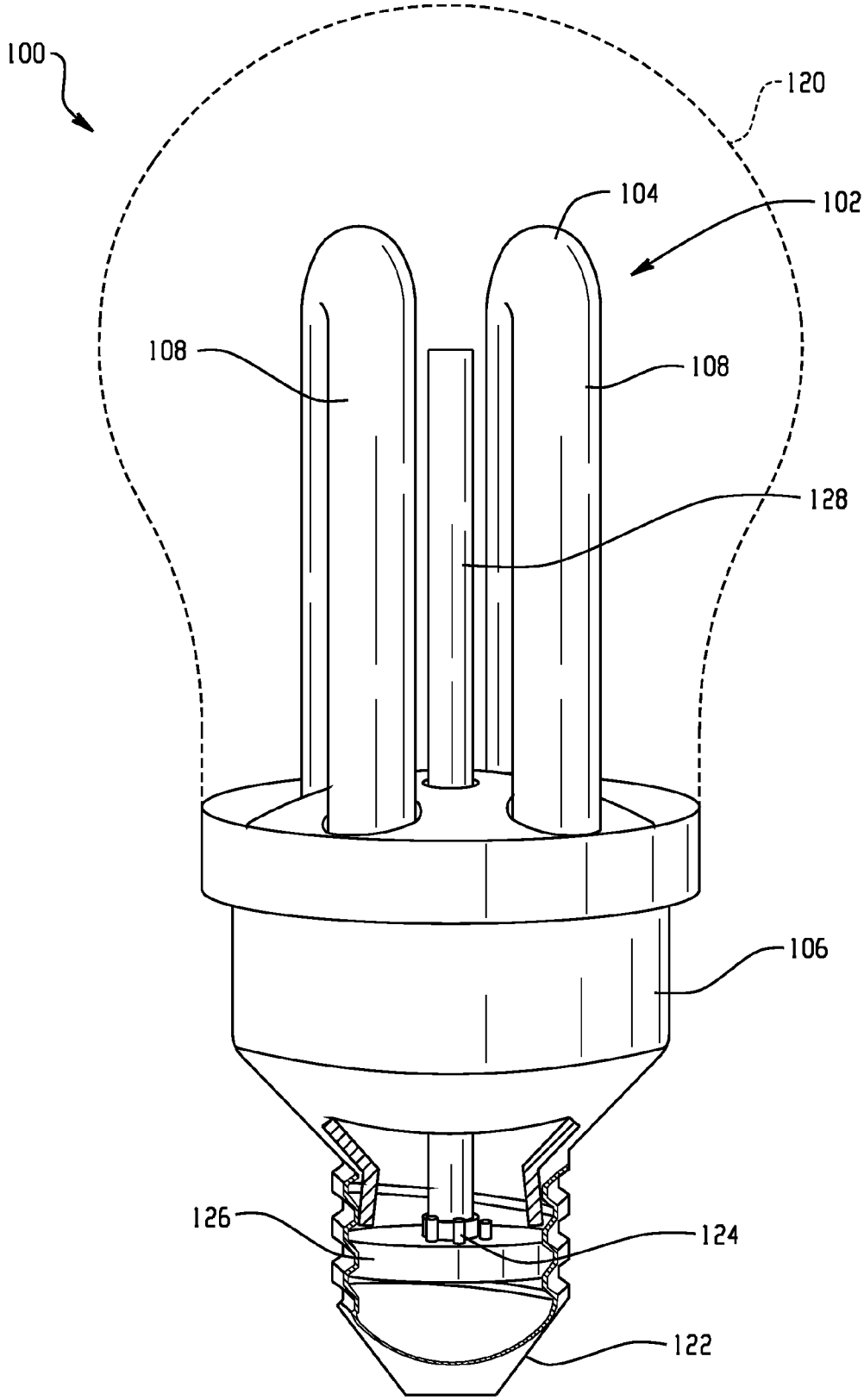
FIG. 1 shows a combined lamp assembly of the type that incorporates the combined driver circuit of the present disclosure.

Turning first to FIG. 1, there is shown an LED integrated fluorescent lamp assembly 100 that has a low pressure fluorescent discharge lamp arrangement 102 that includes at least one low pressure discharge tube 104 attached to a housing or shell 106, typically formed from plastic. In the depicted embodiment, the fluorescent lamp or light source is a CFL lamp that includes two generally U-shaped low pressure discharge tubes 108, each discharge tube radiating white light (3000K-4000K, 480-1200 lm). Of course it will be appreciated that other fluorescent lamp arrangements could be used such as a helical discharge tube having an elongated path and in a manner that is generally well known in the art. The discharge tube arrangement 102 and shell 106 can be assembled together as a single element.

An envelope such as a glass envelope or outer bulb 120 may encompass the fluorescent discharge lamp arrangement 102. The outer envelope is secured to one end of the housing and the other end of the housing typically includes a base such as an Edison-style threaded base 122 for mechanically and electrically connecting the lamp assembly to an associated lamp fitting or lamp holder (not shown). An LED 124 is provided in the base and may be connected to a heat sink such as brass ring 126 to dissipate the heat. In addition, a light guide 128, shown in this embodiment as an elongated linear light guide, receives light from the LED disposed in the base and conveys the light (for example, red light emitted by the LED) into the vicinity of or along the exposed length of the discharge tube (s) 108 where the LED red light is advantageously mixed with the white light from the CFL.

The lamp electronics are oftentimes enclosed within the base. The fluorescent lamp is driven by a conventional AC power supply, and includes a ballast coil 130 and associated electronics to initiate an arc in the discharge tube and provide for steady state operation of the CFL. Since the details and operation of the CFL electronics are well known in the art, further discussion is deemed unnecessary to a full and complete understanding of the present disclosure. It is further understood that the discharge tube requires an elevated voltage level (for example, in the range of 100 volts or more) in order to initiate an arc, and thereafter the continued operation of the arc discharge requires a lower voltage level. As noted above, however, the high voltage level can have an adverse impact on a LED light source.

This disclosure uniquely integrates the driving circuits for the fluorescent lamp and LED into a combined solution that advantageously connects the LED driver to the CFL ballast. More particularly, and with reference to FIG. 2, the ballast coil 130 is the only illustrated component of CFL driver circuit 132. An LED driver circuit 134 is powered from a secondary winding 136 associated with the ballast coil 130. Preferably, the secondary winding is inductively coupled with the transformer/coil of the CFL ballast 130 and the secondary winding drives the LED circuit. Thus, current in the LED circuit is dependent on the CFL ballast being in either ignition or steady state mode. The secondary winding is center-tapped and includes first and second secondary winding portions 136*a*, 136*b* to form a full-wave rectifier via diodes D1 and D2. This arrangement is preferred since the voltage drop is approximately one-half when compared to a Gratez bridge. Further, the applied diodes D1, D2 are low voltage Schottky diodes to provide further increased efficiency.

First and second field effect transistors (FET) Q1, Q2 are incorporated into the circuit to protect the LED during ignition of the CFL. As is known, the transistors rely on an electric field to control the conductivity of a channel, particularly the gate terminal controls electron flow from the source to the drain. Here, the resistor bridge R3, R4 controls the gate voltage of field effect transistor Q2 that is supplied by diode D3 and capacitor C1. When the voltage through the ballast coil is high during CFL ignition, the gate voltage of Q2 rises to the level of opening the FET Q2. When Q2 is opened, the gate of Q1 is pulled low, so that Q1 is closed. Accordingly, no current can flow through FET Q1 and the LED is off.

Figure 2:
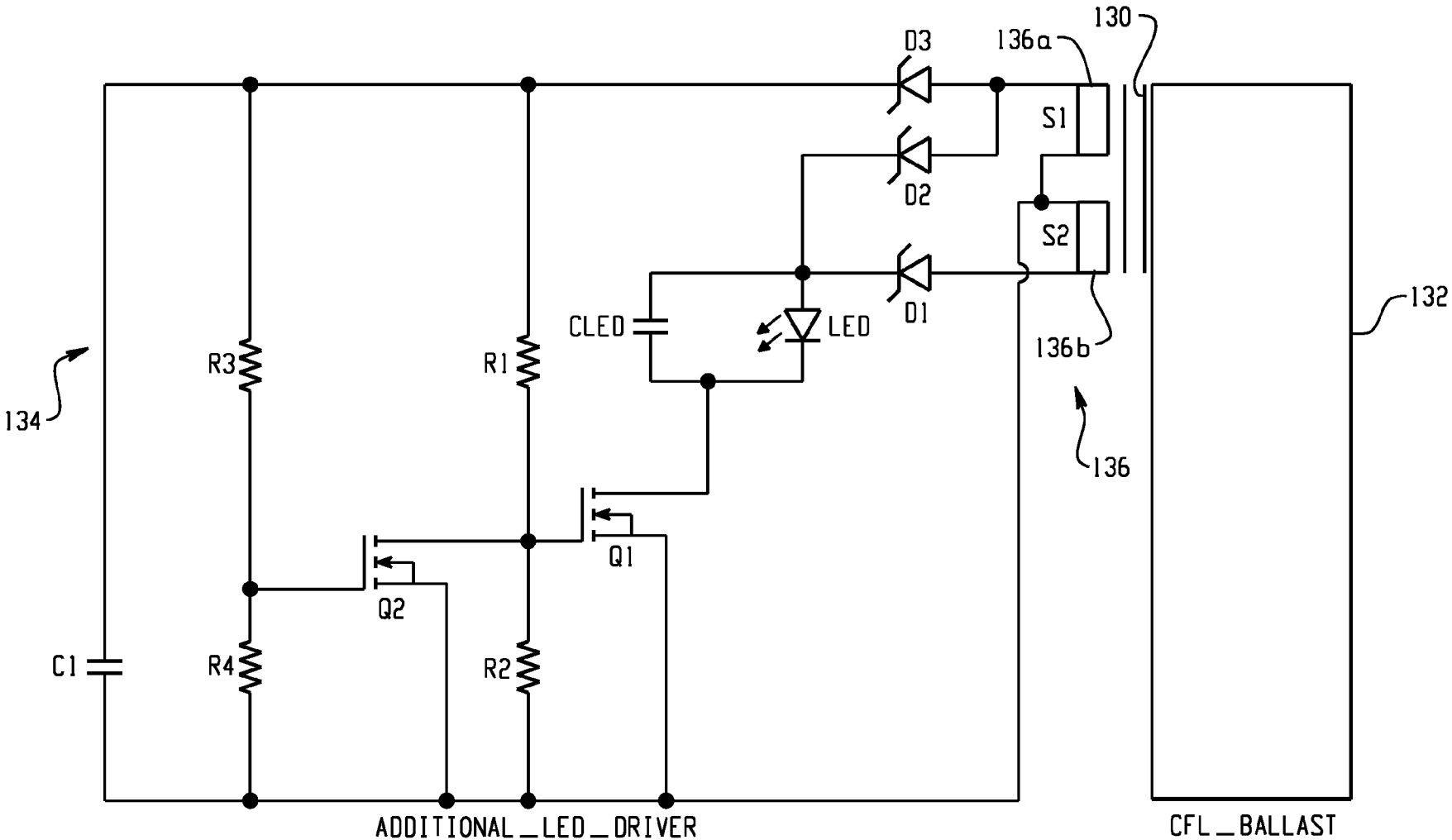
FIG. 2 is a first preferred embodiment of a combined circuit for driving both a fluorescent light source and a LED light source in a combined lamp assembly.

After lamp ignition, however, the voltage in the ballast primary coil is reduced to a steady state operation and likewise the voltage on the secondary winding 136*a*, 136*b* is reduced. As a result of the reduced voltage level, field effect transistor Q2 closes because the gate voltage thereof as set by R3 and R4 is lower than the opening voltage. Consequently, the gate voltage of Q1 is then set by R2, R3 so that Q1 is now open and the LED is illuminated as a result of current flow. The circuit arrangement of FIG. 2 is further beneficial because once the normal, steady operation of the LED is attained, there is a very low voltage drop in this LED circuit since the LED supply current flows through only one FET Q1 and one Schottky diode.

Figure 3:
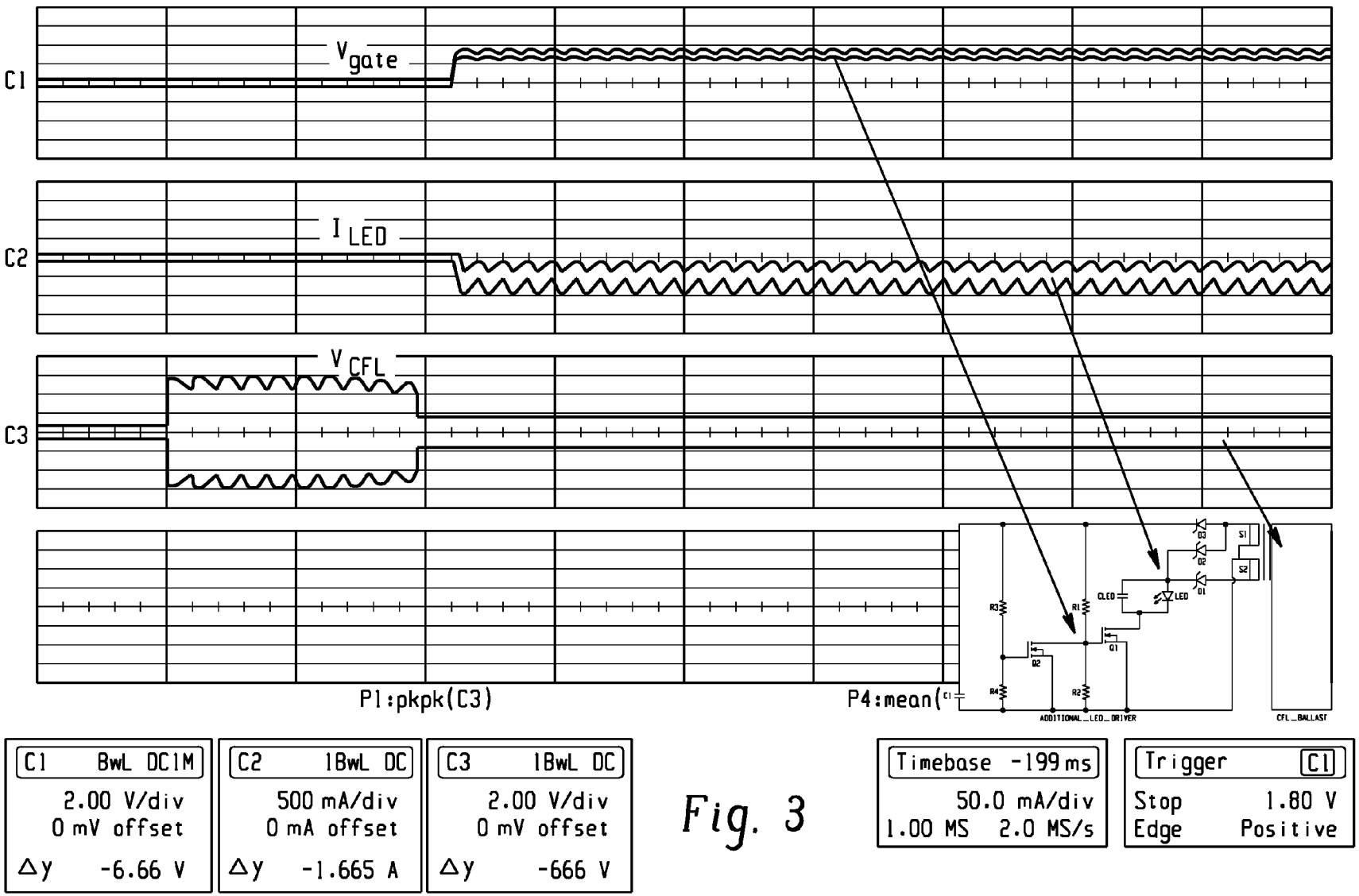
FIG. 3 graphically illustrates different circuit parameters during an ignition phase of the combined lamp assembly.
Figure 4:
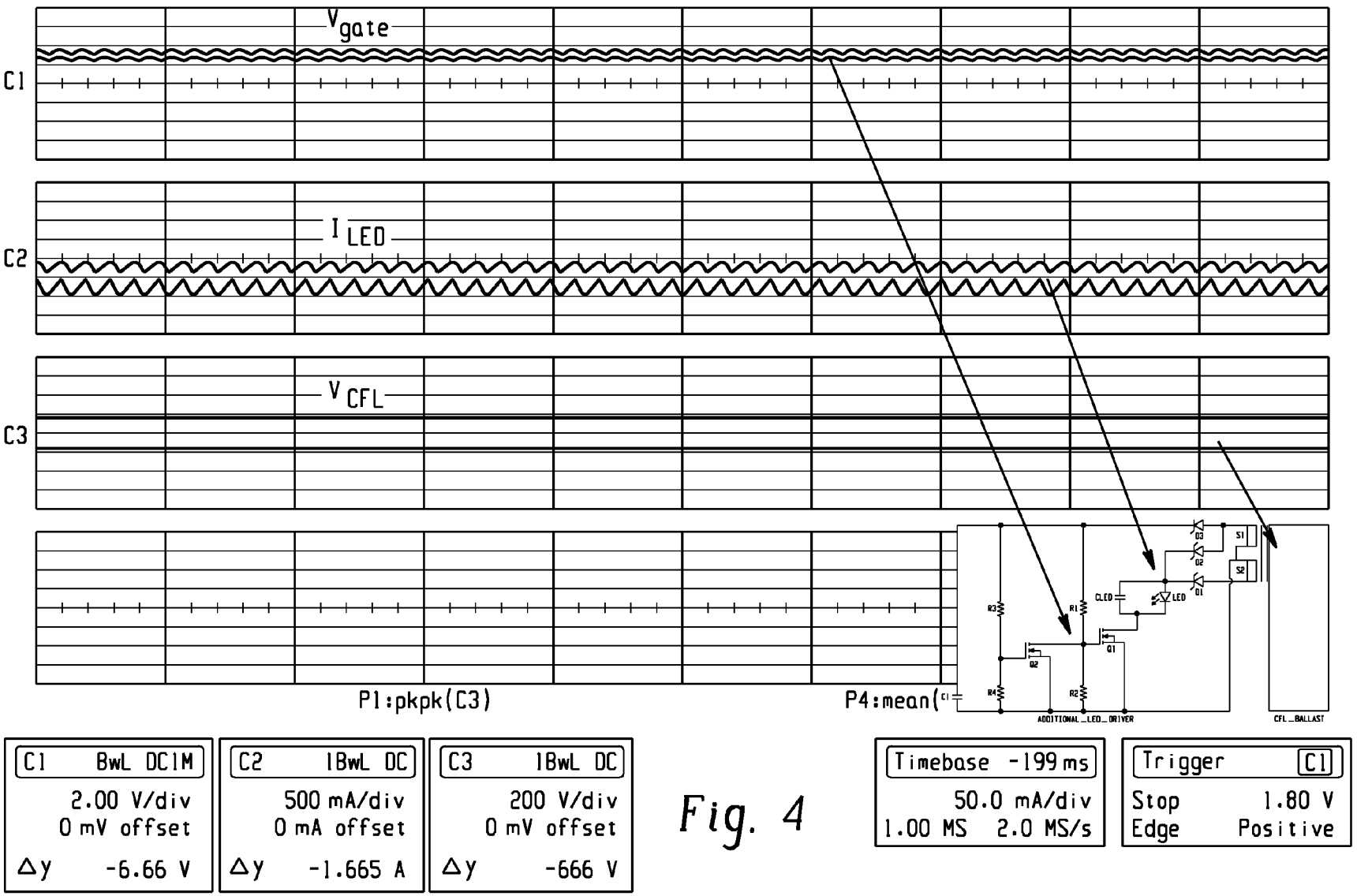
FIG. 4 similarly illustrates the different circuit parameters once the lamp assembly has reached steady state operation.

These relationships are graphically illustrated in FIGS. 3 and 4. Specifically, with reference to FIG. 3, the high voltage $V_{CFL}$ required to initiate the arc in the fluorescent lamp is shown in the bottom plot C3 of the three graphical representations. Once the fluorescent lamp or CFL is ignited, then the voltage $V_{CFL}$ is significantly reduced as represented by the reduced voltage during steady state operation of the CFL and exhibited later in time along the x-axis. The corresponding voltage $V_{gate}$ at the gate of the FET transistor Q1 is shown to increase in the upper plot of FIG. 3 at a time after the ignition voltage level $V_{CFL}$ is reduced to a lower operational level. Likewise, the current $I_{LED}$ flow through the LED as shown in the middle plot of FIG. 3 does not occur until the ignition voltage of the CFL has been reduced to the lower, steady state level. FIG. 4 is a continued graphical representation of these parameters $V_{CFL}$, $V_{gate}$, and $I_{LED}$ during the continued operation of the combined CFL/LED lamp.

Figure 5:
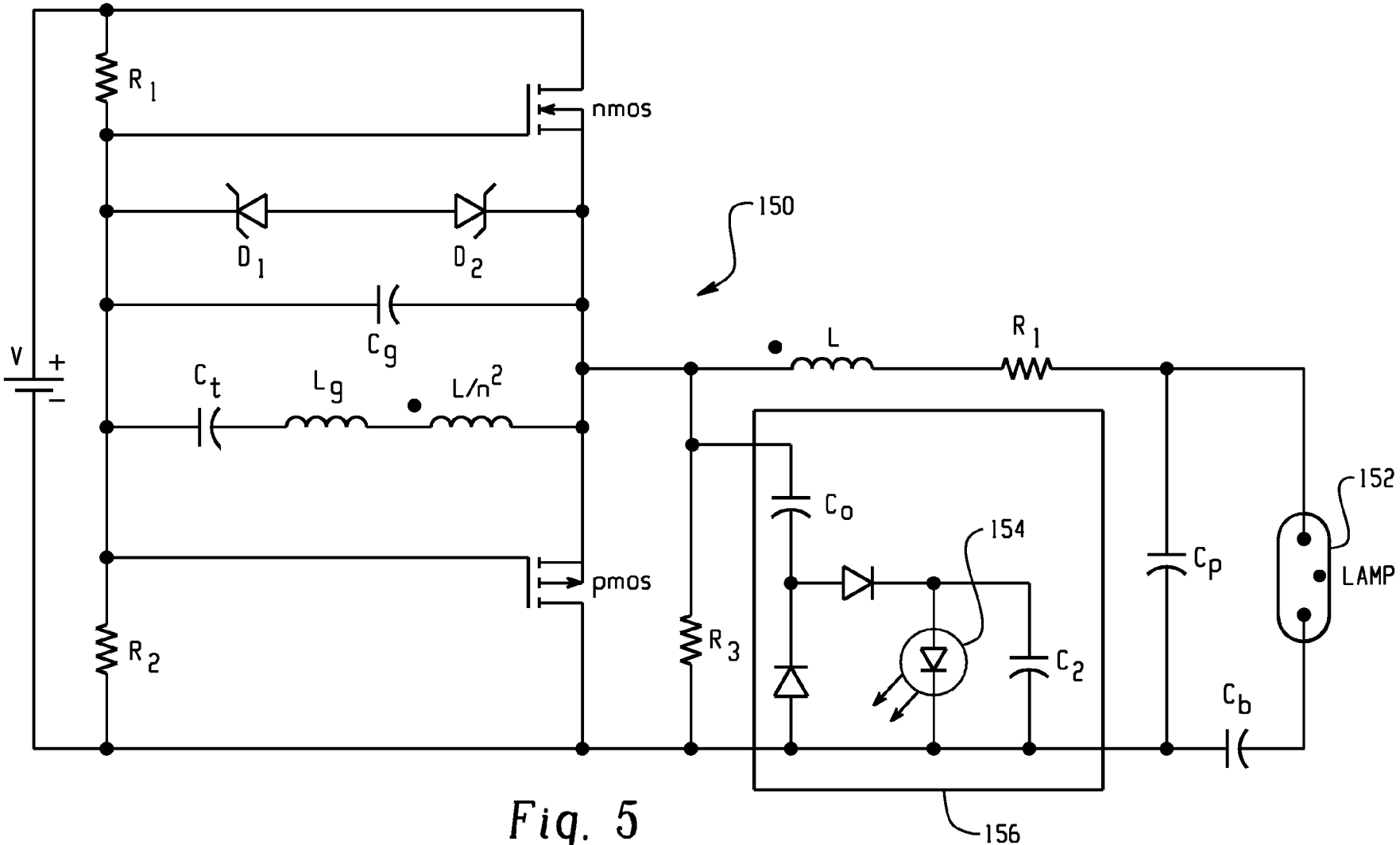
FIG. 5 is a second preferred embodiment of a combined circuit for driving both a fluorescent light source and a LED light source in a combined lamp assembly.

FIG. 5 depicts a typical CFL ballast 150 that operates fluorescent lamp 152 and where the LED 154 is powered front the soft-switching capacitor Co. A charge pump circuit (represented by box portion 156 in FIG. 5) is added to the conventional CFL ballast and the charge pump circuit includes capacitor Co, diodes D3, D4, and filter capacitor C1. The charge pump circuit 156 is driven from the CFL ballast at the switching frequency. During starting, the voltage developed across the capacitor Cp is sufficient to ignite the lamp. The switching frequency at this starting voltage amplitude is close to the steady-state operating frequency when the fluorescent lamp achieves the arc mode. The voltage across capacitor Ci increases to allow the LED to conduct.

Co serves as the soft-switching capacitor and the charge pump capacitor. The current that is supplied to the LED is determined by the value of Co, the switching frequency and the DC bus voltage V. Thus, this arrangement provides for a delay in current supply to the LED and thereby advantageously protects the LED from the large voltage required to ignite the fluorescent lamp since the charge pump circuit only provides current flow to the LED after the ignition voltage has subsided.

Figure 6:
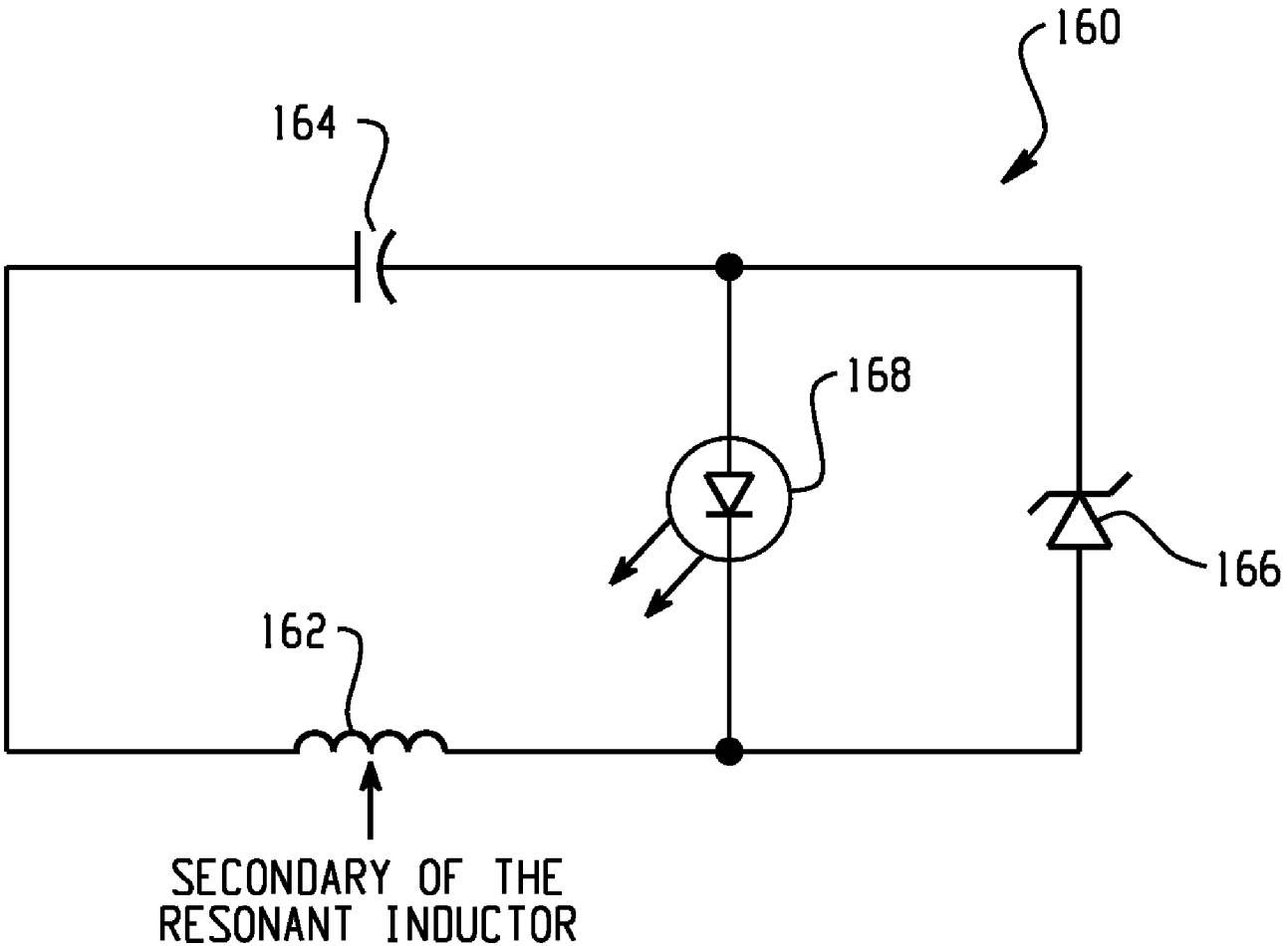
FIG. 6 is a third preferred embodiment of a LED circuit that can be added to a conventional fluorescent light source circuit in a combined lamp assembly.

A relatively simple, alternative LED circuit 160 is shown in FIG. 6. Again, a secondary winding 162 is advantageously used to induce current flow in the LED circuit from the voltage in the primary coil or ballast coil associated with the CFL or fluorescent lamp. A capacitor 164 is used to limit current through the LED circuit 160. A power zener diode 166 is included in parallel with the LED 168 to clamp the voltage across the LED. This simple circuit 160 protects the LED from the high voltage developed by the ballast during ignition of the fluorescent lamp/CFL because the voltage across the LED is clamped by the zener diode.

Figure 7:
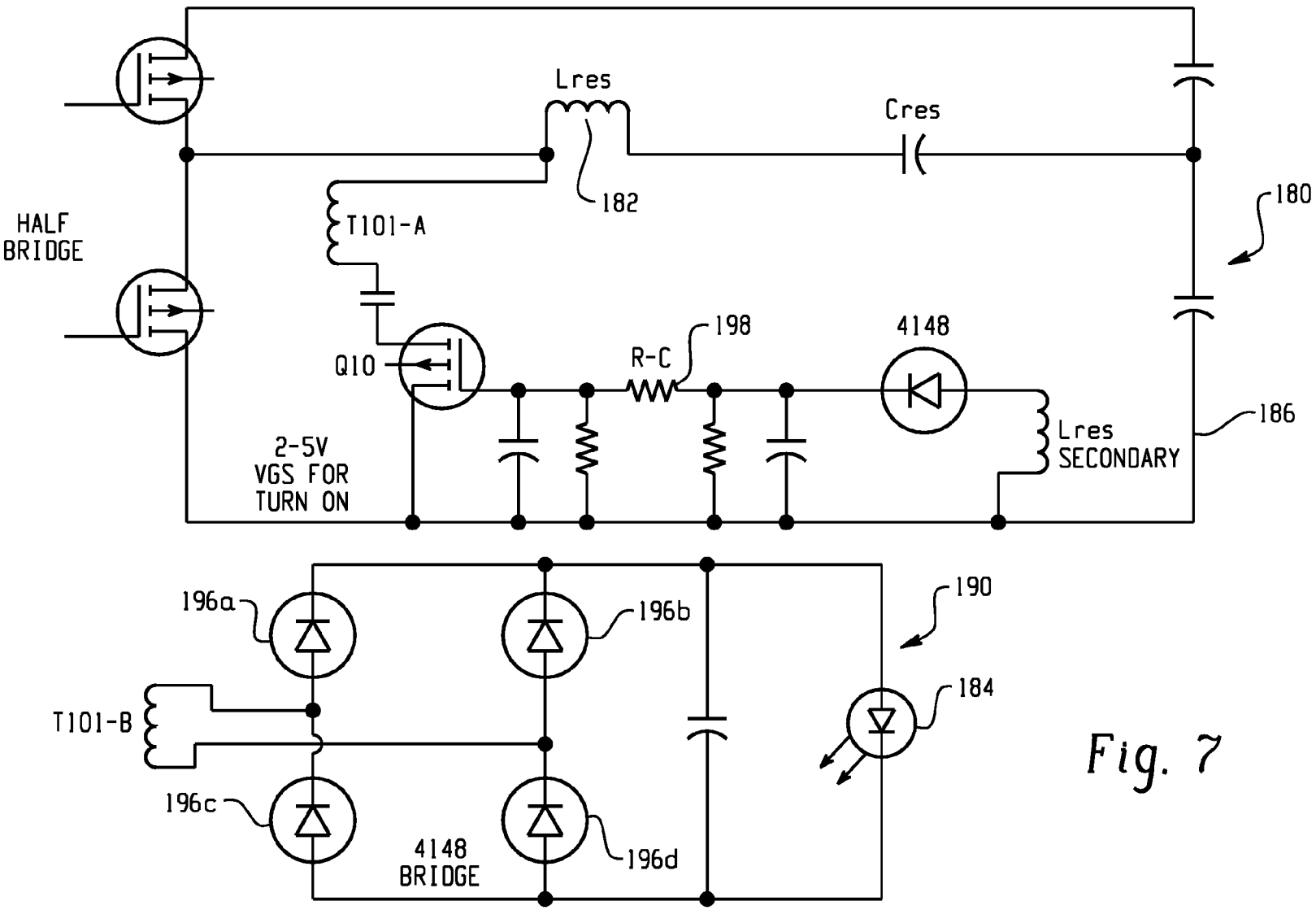
FIG. 7 is a fourth preferred embodiment of a combined circuit for driving both a fluorescent light source and a LED light source in a combined lamp assembly.

Still another embodiment of a ballast circuit 180 for a fluorescent lamp 182 and a LED 184 in a combined lamp assembly is shown in FIG. 7. A secondary coil T101-A and field effect transistor Q10 are added components to a conventional CFL drive circuit 186. After lamp ignition, Q10 turns on, and voltage on T101-A induces a voltage on secondary winding T101-B of the LED circuit portion 190. The square wave voltage is rectified to provide a constant DC Current to drive the LED 184 in the LED circuit portion 190 of the combined circuit.

The four diodes 196*a-d* provide the desired rectification of the square wave voltage. Moreover, the RC network 198 in the fluorescent lamp portion of the combined circuit is configured so that Q10 is not turned on until after lamp ignition. Again, this delay and the coupling via the secondary winding protects the LED from the high voltage associated with fluorescent lamp ignition.

The disclosure has been described with reference to the preferred embodiments. Obviously, modifications and alterations will occur to others upon reading and understanding the preceding detailed description. For example, the LED may be indirectly connected to the secondary winding via a voltage rectifier where the voltage rectifier may include a current generator, a voltage/current generator, a voltage regulator, a timer, and/or an overvoltage protector as is generally known in the art, and without departing from the scope and intent of the present disclosure. It also bears mention that in electronics practice, high voltage generally means in the range of 120-750 kilovolts, and low voltage means 0 to 700 volts. Therefore, the range of high voltage associated with the present disclosure should not be misconstrued with this general understanding of high voltage in the electronics practice. Further, in the present disclosure, the operating current of the LED and the CFL are both on the scale of a few hundred milliamps. Generally, and in the present disclosure, the LED is driven by higher current than the CFL. It is intended that the disclosure be construed as including all such modifications and alterations.

Having thus described the invention, it is now claimed:

1. A circuit for driving a fluorescent lamp and at least one light emitting diode (LED) comprising:

an integrated driver circuit including:

a high frequency, alternating current (AC) circuit that includes at least one ballast coil for driving the fluorescent lamp, and a low voltage, direct current circuit for driving the LED having a secondary winding inductively coupled with the fluorescent lamp ballast coil for driving the LED, whereby power to the LED is delayed until the fluorescent lamp is ignited, and the high voltage required for fluorescent lamp ignition has reduced.

2. The circuit of claim 1 whereby the LED driving circuit is protected from high voltage required for fluorescent lamp ignition via the inductively coupled winding and ballast coil.

3. The circuit of claim 1 wherein the LED is indirectly connected to the secondary winding via a voltage rectifier.

4. The circuit of claim 3 wherein the voltage rectifier includes a current generator.

5. The circuit of claim 3 wherein the voltage rectifier includes a voltage/current generator.

6. The circuit of claim 3 wherein the voltage rectifier includes a voltage regulator.

7. The circuit of claim 3 wherein the voltage rectifier includes a timer.

8. The circuit of claim 3 wherein the voltage rectifier includes an overvoltage protector.

9. A circuit for driving a compact fluorescent lamp (CFL) and at least one light emitting diode (LED) comprising:

an integrated driver circuit including a high frequency, alternating current (AC) circuit that includes at least one ballast coil for driving the CFL, and a low voltage, direct current circuit for driving the LED;

means for delaying power to the LED circuit until after the CFL has been ignited.

10. The circuit of claim 9 wherein the power delaying means includes a secondary winding inductively coupled with the CFL ballast coil for driving the LED.

11. The circuit of claim 9 wherein the power delaying means includes a current limiting capacitor.

12. The circuit of claim 9 wherein the power delaying means includes a charge pump capacitor.

13. A method of driving a lamp assembly that includes at least one fluorescent lamp and at least one light emitting diode (LED) and a combined driver circuit for supplying both the fluorescent lamp and the LED, comprising:

supplying high voltage AC supply in a first portion of the driver circuit to the fluorescent lamp;

supplying low voltage DC supply in a second portion of the driver circuit to the LED;

providing a secondary winding in the second portion of the driver circuit that is inductively coupled with a ballast coil in the first portion of the driver circuit that drives the fluorescent lamp; and delaying the voltage supply to the LED until after ignition of the fluorescent lamp.

14. The method of claim 13 wherein the delaying step includes precluding current flow to the LED until a predetermined voltage is provided by the secondary winding.

15. The method of claim 14 wherein the delaying step includes providing voltage to a gate terminal of a first field effect transistor (FET) to permit current flow to the LED.

16. The method of claim 15 further comprising providing a second field effect transistor (FET) for protecting the LED against overvoltage wherein the drain of the first FET supplies a gate terminal of the second FET.

17. A method of driving a lamp assembly that includes at least one compact fluorescent lamp and at least one light emitting diode (LED) and a circuit for driving both the CFL and the LED, comprising:

supplying high voltage AC supply in a first portion of the circuit to the CFL; and supplying low voltage DC supply in a second portion of the circuit to the LED after the high voltage supplied to the CFL for ignition has subsided.

18. The method of driving the lamp assembly of claim 17 further comprising inductively coupling a winding of the circuit second portion with a ballast coil in the first portion of the circuit.

19. A method of driving a lamp assembly that includes at least one fluorescent lamp and at least one light emitting diode (LED) and a combined driver circuit for supplying both the fluorescent lamp and the LED, comprising:

supplying high voltage AC supply in a first portion of the driver circuit to the fluorescent lamp;

supplying low voltage DC supply in a second portion of the driver circuit to the LED; and delaying the voltage supply to the LED until after ignition of the fluorescent lamp.

* * * * *